United States Patent [19]

Chapman

[11] 4,432,108

[45] Feb. 21, 1984

[54] THERAPEUTIC LEG SUPPORT

[76] Inventor: Gerda L. Chapman, 1805 Montana Ave., Coeur d'Alene, Id. 83814

[21] Appl. No.: 309,922

[22] Filed: Oct. 9, 1981

[51] Int. Cl.[3] ..... A47C 21/00

[52] U.S. Cl. ..... 5/443; 297/439

[58] Field of Search ..... 5/443, 437, 440, 433; 297/438, 439

[56] References Cited

U.S. PATENT DOCUMENTS

| | | | |
|---|---|---|---|
| 830,776 | 9/1906 | Flagg | 5/443 |
| 1,118,973 | 12/1914 | Troesch | 5/443 |
| 1,151,894 | 8/1915 | Meinecke | 5/433 |
| 1,452,915 | 4/1923 | Kennedy | 5/443 |
| 1,619,685 | 3/1927 | Updegrove et al. | 5/443 |
| 3,603,639 | 9/1971 | Wilson | 297/219 |
| 4,118,812 | 10/1978 | Pangburn | 5/433 |

*Primary Examiner*—Alexander Grosz

*Attorney, Agent, or Firm*—Wells, St. John & Roberts

[57] ABSTRACT

A leg support for holding the user's leg in proper position for relieving back pain and discomfort, both from the "backlying" or supine position and for the "sidelying" positions. The support is adjustable to allow selective angular adjustment of the upper and lower legs at any of an infinite number of angles between a folded upright orientation and a flat unfolded position. The support may be flattened to the unfolded position beneath the user, allowing the user to shift from a "backlying" to a "sidelying" position without removing the support.

13 Claims, 8 Drawing Figures

THERAPEUTIC LEG SUPPORT

FIELD OF THE INVENTION

The present invention relates to therapeutic appliances and more particularly to such appliances used to relieve lower back pain with the patient in a supine "backlying" or "sidelying" position.

BACKGROUND OF THE INVENTION

It has been found that lower back pain, varicose veins, phlebitis, muscle tension and other maladies can be relieved in many cases when the patient is in a supine rest position by supporting the upper and lower legs in an elevated position. This has been done in the past by using one or more pillows placed under the knees. The knees must be elevated enough to relieve tension to the lumbar vertebra, thereby reducing low back pain and discomfort. Pillows by their nature are soft and will gradually deflect, adversely affecting their therapeutic use. They must be repeatedly repositioned. Pillows that settle out of adjustment gradually allow the legs to shift positions and eventually the pain reappears. This may happen several times through the night and can easily disrupt the patient's sleep.

Another recommended resting position for low back disorder is elevating the upper leg in a "sidelying position. The same pillows may be used here as used in the "backlying" position. Only one of the pillows need be used. It is placed between the legs to hold the upper leg at an elevation so as to not place a strain on the hip area and, consequently, the lumbar area of the spine.

Needless to say, shifting from the "backlying" position to the "sidelying" position is a tedious and frustrating task, again taking from the patient's sleeping time and often disrupting the sleep of a partner.

Various implements have been devised for holding a person's trunk or spine in a selected reclining position when at rest. Probably the most popular is the modern adjustable hospital bed. Of course, the average person is unable to afford an adjustable hospital bed, especially for treating back pain or discomfort that is not constant.

Another attempt at a solution is the "Comfort Wedge" by Comfort Products, 30812 Huntwood Avenue, No. 11, Hayward, Calif. 94544. This device is comprised of a molded form for supporting the legs while the patient rests in a supine, "backlying" position. Serviceability is limited by the preselected angle and elevation at which the legs are elevated. Also, the device cannot be used at all effectively in the "sidelying" position.

The present invention provides hinged support members that adjustably support the upper and lower legs from a "backlying" position. The support members may be adjusted to nearly any selected angle from a substantially flat position wherein the patient may move to a "sidelying" position, to a nearly upright condition wherein the hinged support members substantially face one another. The legs of nearly any individual can be accommodated in a position at which a maximum therapeutic benefit is realized. The selected position may be held indefinitely because the support members are rigid and are held securely at the desired angle. "Sidelying" is made possible without requiring removal of the present support from beneath the patient. The support members are simply adjusted to the unfolded nearly flat orientation, allowing the patient to assume a "sidelying" position with a pillow. Adjustability of the present support allows quick and nearly effortless shifting between the "sidelying" and "backlying" positions. These changes may be made quickly and silently so as not to prolong the wakefulness of the patient or disturb a sleeping partner.

DETAILED DESCRIPTION

Figure 5:
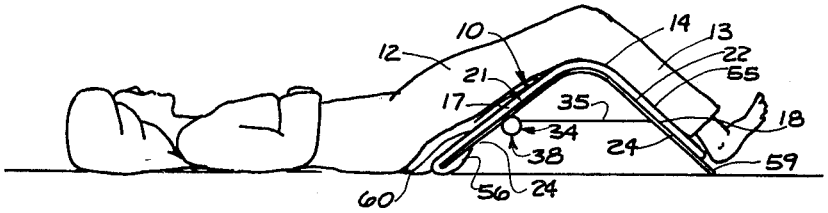
FIG. 5 is a diagrammatic view showing the present support with a patient in a "backlying" position.
Figure 6:
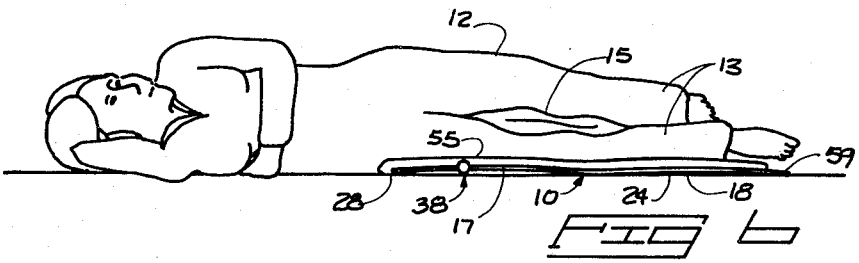
FIG. 6 is a diagrammatic view of the present support in an unfolded position with a patient in a "sidelying" position.

FIGS. 5 and 6 illustrate the present support at 10 being used by a patient for orthopedic treatment for low back disorder. The support is intended to position and support the upper legs 12 and lower legs 13 to decrease muscle tension and relieve discomfort and pain.

FIG. 5 shows the patient in a "backlying" position wherein the upper and lower legs 12 and 13 are elevated and bent at the knee joint so the dorsal surface 14 of the knee forms the apex of an angle.

FIG. 6 shows the patient in a "sidelying" position wherein the support 10 has been folded flat and the legs are supported one on another with a slight elevation for the upper leg provided through a pillow 15 held between the legs.

Both the above positions are recommended in orthopedic treatment of lower back disorders. The positions are especially helpful during sleep and rest periods. The present support 10 is uniquely useful to assist the patient in attaining either of the described positions quickly, silently, and without strenuous effort.

Figure 7:
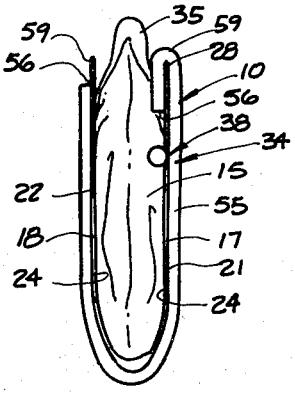
FIG. 7 is a side elevational view of the present support folded to a storage condition.
Figure 8:
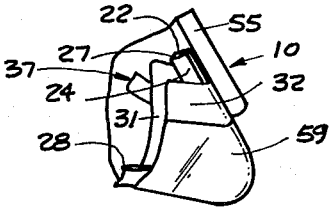
FIG. 8 is a fragmentary pictorial view of a portion of the present support.

The present support is shown in structural detail in FIGS. 1 through 4, 7, and 8. As shown, the support is basically comprised of two rigid support frame members—an upper leg support frame member 17 and a lower leg support frame member 18. The frame members 17 and 18 are hinged at 20 for pivotal motion about a transverse hinge axis between a folded position as shown in FIG. 7 wherein the members substantially face each other, and an unfolded orientation wherein both frame members are substantially flat as shown in FIG. 6. An infinite variety of positions may be selected between the two extreme positions.

The upper leg frame member 17 defines an upper leg support surface 21. The lower leg support frame member 18 defines a lower leg support surface 22. Both members 17 and 18 include inwardly facing bottom surfaces 24.

Figure 1:
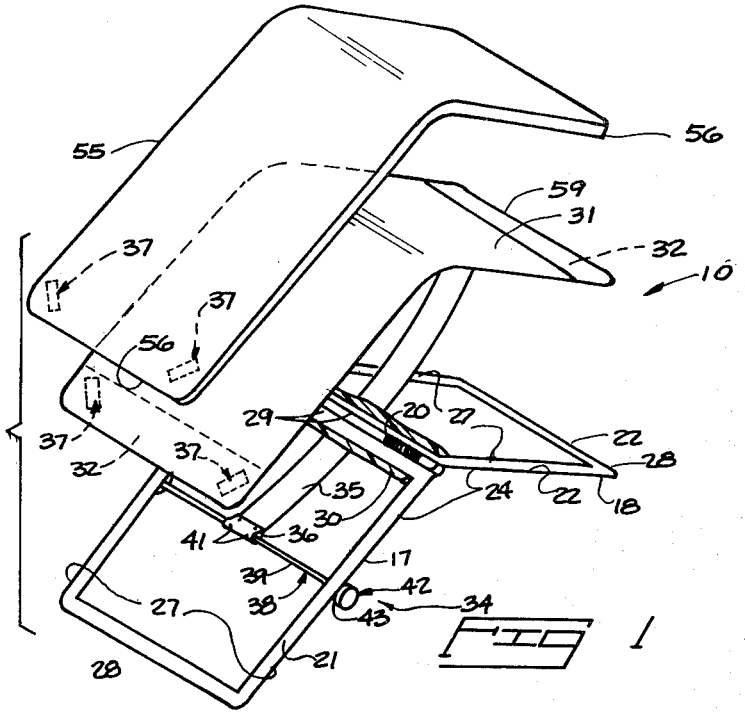
FIG. 1 is an exploded view of the present support.
Figure 2:
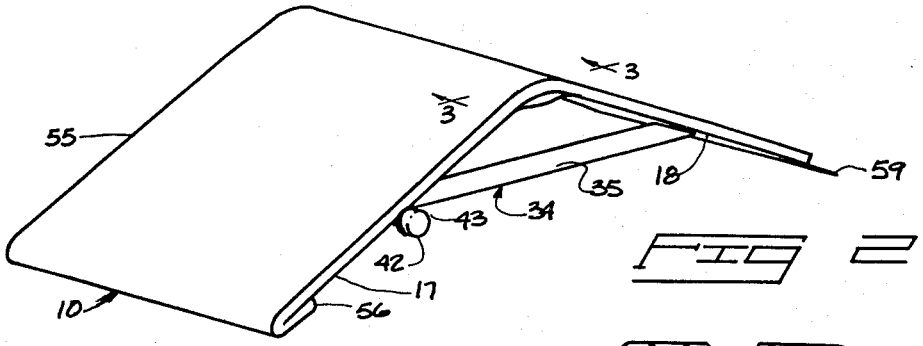
FIG. 2 is a pictorial view of the support assembled and in an operative position.

The frame members are of a generally rectangular rim shape, surrounding open rectangular areas. Each frame member includes parallel elongated side edges 27. The side edges 27 are joined by outside end edges 28 and parallel inside end edges 29. The inside end edges 29 are directly adjacent the hinge 20 (FIG. 1). The frame members are bent inwardly near the inside edges 29 to conform to the curvature of the dorsal knee surface 14 when the support is folded to operative positions as shown in FIGS. 2 and 5.

Figure 3:
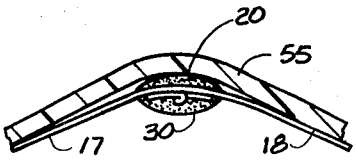
FIG. 3 is a sectional view taken substantially along line 3—3 in FIG. 2.

It is preferred that some device such as a pad 30 cover the frame inside end edges 29 and the hinge 20 to prevent pinching at the hinge areas of the frame. The pad 30 may simply be formed of a short length of foam cushion material wrapped about the inside frame end edges 29 and the intermediate hinge substantially as shown in FIG. 3.

The frame members 17 and 18, as shown, provide peripheral support to a fabric cover 31. The fabric cover 31 spans the rectangular openings through the rigid frames and is held taut between the edges of the frame members to provide yieldable support to the user's legs. It is understood, however, that the frame members 17 and 18 could be constructed of solid sheet material, without the fabric cover 31.

The fabric cover 31 may be permanently attached to the frame members 17, 18, or may be removably attached as by end pockets 32 for receiving the outside frame end edges 28. The pockets 32 are shown by dashed lines in FIG. 1 and partially by the fragmentary illustration in FIG. 8. The ends of the fabric cover 31 slip over the outside end edges 28 of the frame members. Similar pockets 33 or other attachments (FIG. 4) may be provided along the sides of the fabric cover in order to hold it tight across the support frames.

Means is generally illustrated at 34 interconnecting the frame members between the bottom frame surfaces 24 to allow adjustable positioning of the frame members about the hinge axis. Adjustment can be made to determine any desired angular relationship between the frame members from the unfolded position (FIG. 6) to the folded orientation substantially as shown in FIG. 7.

Figure 4:
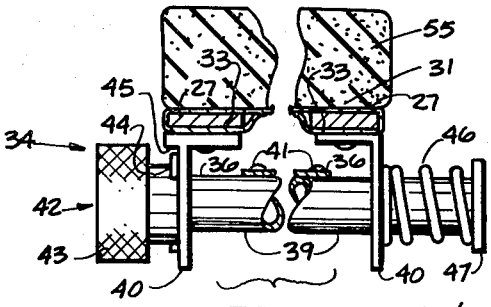
FIG. 4 is an enlarged fragmentary view, illustrative of means for adjustably positioning support members of the present leg support.

FIGS. 1, 2 and 4 show a form of means 34 that is preferred for ease of operation. However, it is well understood that other mechanisms could be used for allowing selective angular adjustment of the frame members. For example, ratchet mechanisms such as those currently used with reclining "lawn chairs" (not shown) could be used. Other mechanisms are also envisioned within the scope of means 34 that, for the sake of brevity, will not be described in detail.

Preferably, means 34 includes a strap 35 that extends from the lower leg support frame member 22 to an end 36 mounted to a winding means 38. The winding means 38 is provided for selectively taking up and letting out the strap 35 to correpondingly draw the frame members together about the hinge axis, or allow them to separate to the unfolded orientation.

The strap 35 may be attached directly to the lower leg support surface 22 or may be supplied as part of the fabric cover 31.

The winding means 38 is best illustrated in FIGS. 1 and 4. It may be comprised of an elongated spool shaft 39 carried transversely across the bottom surface 24 of the upper leg support frame member 17. Appropriate brackets 40 may journal the spool shaft 39 for rotation about its central axis. Rivets 41 or other appropriate means for attachment is provided to secure the free strap end 36 to the spool shaft 39. Rotation of the shaft will therefore cause the strap to be wound onto or off of the spool shaft.

A crank means 42 is provided at one end of the shaft 39 to allow manual rotation of the shaft and thereby allow for angular adjustment of the frame members 17 and 18. Crank means 42 may be provided in the form of a knurled knob 43 having a roll pin 44 extending through both the knob and the shaft end. The roll pin 44 will normally rotate into abutment with a stop surface 45 on the adjacent bracket. The pin will therefore hold the spool shaft 39 in a selected position. However, when adjustment is to be made, the knurled knob 43 may be pulled outwardly (to the left in FIG. 4) to disengage the roll pin 44 from the surface 45. This movement is resisted by a compression spring 46 located at the opposite end of the shaft 39. A cap 47 affixed to the shaft end compresses the spring against the adjacent bracket 40 as the knob is pulled outwardly. The spring and cap arrangement assure that the roll pin will not be inadvertently disengaged from the stop surface 45 and allow the support frame members to unfold freely to the unfolded position.

Adjustment is made simply by pulling outwardly on the knob 43 and rotating it and the spool shaft 39 to take up or release the strap 35. This causes corresponding folding motion of the frame members 17 and 18. When the selected position is found, the knob is released and the spring 46 automatically pulls the knob back inwardly to bring the roll pin 44 into abutment with the surface 45.

It is preferred that a cushion or pad 55 be provided to cover the upper support surfaces 21 and 22. The pad 55 is rectangular and elongated, extending to a length slightly greater than the combined length dimensions of the frame members when in the flat, unfolded orientation. One end of the pad 56 may therefore be folded over the outside end edges 28 of the upper leg support frame member 17. Means is provided at 37 (FIG. 8) for attaching the pad to the frame members. Means 37 may simply be comprised of matching fabric fastening strips sold under the trademark "Velcro" strips strategically positioned on the fabric cover 31 or frame and appropriate surfaces of the pad 55. The pad ends, when mounted to the frame members, assure that the rigid frame end edges 28 will not damage a supporting surface.

A low friction cover such as a smooth plastic sheet may be provided at 59 at one end of the frame members. The sheet 59 is preferably positioned over the outside end edge 28 of the lower leg support surface 22. The low friction surface of cover 59 will slide freely over most surfaces to facilitate adjustment of the angular position between the two support members. The remaining upper leg support member 17 does not require such a friction free surface. Instead, it is preferred that the outer end edge 28 of the upper leg support member not move during adjustment since such movement would require the user to physically shift his or her body along with the support.

FIGS. 5, 6 and 7 show the pillow 15 that may be used in conjunction with the present support. FIG. 7 illustrates a convenient way by which the pillow may be stored between the folded frame members 17 and 18.

The pillow 15 may be used in the "backlying" position (FIG. 5) to provide additional support and weight distribution of the upper leg and buttock area. The pillow 15 can be suitably adjusted under the buttocks and legs by the patient for best comfort.

The pillow 15 can be conveniently shifted from the backlying position to a position between the legs in the "sidelying" position as shown in FIG. 6. Here, the pillow is used to elevate the top leg to a position nearly horizontally level with the upper hip joint, in order to maintain proper hip alignment and reduce or prevent stresses that would normally occur with the hip out of proper alignment with the spine.

Operation of the present support 10 may be easily understood with reference to FIGS. 5, 6, and 7. Typically, the unit will be sold or transported in the folded, closed condition shown in FIG. 7. The folded configuration of the support facilitates transport, handling and storage.

It should be noted that use of the present support is not restricted to beds. The lightweight, compact nature of the support facilitates its use outdoors as well as inside. It can be constructed of rugged, weatherproof materials that will enable use while camping, sunbathing, in or on nearly any surface that will support the user in a supine position.

The support may be used in the "backlying" position to support the upper and lower legs firstly by pulling outwardly on the knurled knob 43 to disengage the roll pin 44 from the stop surface 45. This allows the spool shaft 39 to rotate freely and let out the strap 35 as the frame members are pulled apart about the axis of the hinge.

It may be preferred to hold the knurled knob in the outward position until the frame members 17 and 18 can be folded to the relatively flat position that is shown in FIG. 6. The user can then assume a supine position with his or her legs resting along the length of the flattened frame members. The dorsal knee surface 14 is positioned directly over the hinge so subsequent motion of the surfaces will cause similar relative pivotal motion of the upper and lower legs.

The user can then begin turning the knurled knob 43 to progressively wind the strap 35 onto the shaft 39. This decreases the strap length and causes the frame members to begin folding upwardly. The knob can be turned until a desired angular position is achieved. A 30°–45° angle is the typical recommended angular range relationship of the lower and upper legs to a flat surface. The support can be adjusted to bring the legs to any angular position within the preferred range if desired. Actually, the knob can be used to select any of an infinite number of angular positions for the frame members between the flat unfolded position to the completely folded position.

As the frame members are adjusted angularly relative to one another, the weight of the patient's legs on the two frame members, serves to hold the device in position. The low friction cover 59 situated at the outer end of the lower leg support member 18 is allowed to slide relatively freely over the support surface, this motion will therefore accommodate or produce the angular variations of the support members during adjustment while the outer end of the upper leg support member will remain relatively stationary.

When the appropriate position has been selected, the user simply releases the knurled knob 43. The spring 46 then pulls the shaft 39 back, moving the roll pin 44 to reengage the stop surface 45. This locks the shaft against further rotation. The frame members will therefore stay at the selected angular orientation until further adjustments are made by pulling out and turning the knurled knob 43.

The pillow 15 may or may not be positioned beneath the buttocks and upper leg area of the user, depending upon the user's preference.

The benefits realized from the "backlying" and "sidelying" positions are well understood in orthopedic practice. The present support provides a quick, relatively effortless and sure way for the user to assume both proper "backlying" and "sidelying" positions for maximum therapeutic benefit.

It is noted that adjustments in the "backlying" position can be made without requiring the user to lift his or her legs onto the supports. Instead, the supports are used to elevate the legs. Additional angular adjustment of the legs is made simply by turning the knob 43, rather than requiring that the patient forceably lift his or her legs from the support while such adjustments are made. Furthermore, there is no need for periodic readjustment of the supports since they will stay in the adjusted position as long as the user so desires.

A person using the "backlying" position typically cannot comfortably maintain that position throughout a full night's sleep. The "sidelying" position has been used as an effective alternate to the "backlying" position and affords a comfortable alternate to the "backlying" position.

The present support can be quickly and effectively used to shift from the "backlying" position shown in FIG. 5 to the "sidelying" position shown in FIG. 6. This is done simply by pulling the knurled knob 43 outwardly and allowing the frame members 17 and 18 to spread to a fully open, flat orientation. The patient, who is now lying flat, may turn onto his or her side so the bottom leg rests on the flattened support and the top leg rests on the bottom leg. The pillow 15 can then be used to support the top leg to an elevation substantially equal to that of the hip joint. This is easily done simply by placing the pillow 60 between the legs at a determined position from the groin to just below the knee, depending upon the leg elevation required.

Note when the support is allowed to move to the unfolded, flattened position, that the outer end of the upper leg frame member stays stationary while the low friction surface 59 allows the remaining outer end 28 of the lower leg frame member 18 to slide over the support surface. This simulates the natural motion of the legs so there is no substantial relative movement between the pad 55 and the user's legs.

The two positions described above can be alternated throughout the night or throughout the rest period simply by adjusting the knurled knob 43. It is pointed out that this can be done quietly and does not require that the user remove the support from its original position.

I claim:

1. An adjustable therapeutic leg support, comprising:

a pair of rigid frame members hinged for pivotal motion about a transverse hinge axis and including an upper leg support frame member with an upper leg support surface and an opposed bottom surface on one side of the hinge axis and a lower leg support frame member with a lower leg support surface and an opposed bottom surface on an opposite side of the hinge axis;

said rigid frame members including free outside end edges with surfaces thereon for directly contacting a supporting surface such as a bed;

means interconnecting the frame members on opposite sides of the hinge axis for adjustably positioning the frame members about the hinge axis at any desired angular relationship between an unfolded orientation wherein both frame members are substantially flat and a folded orientation wherein both frame members are substantially upright and face one another.

2. The leg support as claimed by claim 1 wherein the rigid frame members each include parallel inside and outside end edges, with the inside edges being joined by a hinge along the hinge axis; and wherein the outside end edge of the lower leg support frame member includes a low friction covering to facilitate sliding over a support surface such as a bed.

3. The leg support as claimed by claim 1 wherein said means interconnecting the frame members is comprised of:

an elongated strap mounted to the lower leg support frame member and extending to a free end;

winding means on the upper leg support frame member mounting the free end of the strap for selectively taking up and letting out said strap to correspondingly draw the frame members together and allow them to part about the hinge axis.

4. The leg support as claimed by claim 3 wherein the winding means is comprised of:

a spool shaft rotatably mounted to the upper leg support frame member adjacent the bottom surface and having the free end of said strap attached thereto;

selectively operable crank means operably engaging the spool shaft for manual manipulation, causing rotation of the spool shaft, to wind and unwind the strap.

5. The leg support as claimed by claim 1 wherein the leg support frame members are bent transversely adjacent the hinge axis to present an upwardly facing curve complementary to the dorsal surface of the knee.

6. The leg support as claimed by claim 1 further comprising:

an elongated pad having a length dimension between pad ends;

means for releasably attaching the pad to the rigid frame members over the leg support surfaces and with one pad end being folded over the free end of a selected leg support frame member and attached to the selected support member along the bottom surface thereof.

7. The leg support as claimed by claim 6 further comprising a low friction cover on the pad at the free end edge of the remaining leg support frame member.

8. An adjustable therapeutic leg support, comprising:

a pair of rigid frame members hinged for pivotal motion about a transverse hinge axis and including an upper leg support frame member with an upper leg support surface and an opposed bottom surface on one side of the hinge axis and a lower leg support frame member with a lower leg support surface and an opposed bottom surface on an opposite side of the hinge axis;

an elongated strap mounted to the lower leg support frame member and extending to a free end;

winding means on the upper leg support frame member mounting the free end of the strap for selectively taking up and letting out said strap to correspondingly draw the frame members together and allow them to part to any desired angular relationship between a folded orientation wherein both leg support frame members are substantially upright with bottom surfaces facing one another and an unfolded orientation wherein both leg support frame members are substantially flat.

9. The leg support as claimed by claim 8 wherein the leg support frame members each include parallel inside and outside end edges, with the inside edges being joined by a hinge along the hinge axis; and wherein the outside end edge of the lower leg support frame member includes a low friction covering.

10. The leg support as claimed by claim 8 wherein the winding means is comprised of:

a spool shaft rotatably mounted to the upper leg support frame member adjacent the bottom surface and having the free end of said strap attached thereto;

selectively operable crank means operably engaging the spool shaft for manual manipulation, causing rotation of the spool shaft to wind and unwind the strap.

11. The leg support as claimed by claim 8 wherein the leg support frame members are bent transversely adjacent the hinge axis to present an upwardly facing curve complementary to the dorsal surface of the knee.

12. The leg support as claimed by claim 8 wherein the leg support frame members include free outside end edges and inside end edges, with the inside and edges hinged together and further comprising:

an elongated pad extending between opposed pad ends;

means for releasably attaching the pad to the frame members over the leg support surfaces and with one pad end being folded over the free outside end edge of a selected leg support frame member and attached to the selected support member along the bottom surface thereof.

13. The leg support as claimed by claim 12 further comprising a low friction cover on the remaining support member adjacent the remaining pad end.

* * * * *